United States Patent [19]

Menegoli

[11] Patent Number: 5,072,563

[45] Date of Patent: Dec. 17, 1991

[54] MODULAR ROOFING PANEL

[75] Inventor: Fabio Menegoli, San Pietro in Cariano, Italy

[73] Assignee: Iscom S.r.l., Verona, Italy

[21] Appl. No.: 541,432

[22] Filed: Jun. 25, 1990

Related U.S. Application Data

[63] Continuation of Ser. No. 237,925, Aug. 29, 1988, abandoned.

[30] Foreign Application Priority Data

Sep. 8, 1987 [IT] Italy ..... 84965 A/87

[51] Int. Cl.[5] ..... F04D 1/28; F04D 1/34; F04D 1/36

[52] U.S. Cl. ..... 52/537; 52/520; 52/529; 52/533; 52/540; 52/546; 52/547

[58] Field of Search ..... 52/520, 529, 530, 537, 52/538, 531, 528, 545, 546, 540, 543, 547, 551, 309.9, 533

[56] References Cited

U.S. PATENT DOCUMENTS

| | | | |
|---|---|---|---|
| 2,172,270 | 9/1939 | Ansel | 52/549 |
| 3,209,503 | 10/1965 | Mostoller | 52/529 |
| 3,320,711 | 5/1967 | Johnson | 52/520 |
| 3,469,873 | 9/1969 | Glaros | 52/586 |
| 3,590,543 | 7/1971 | Heirich | 52/520 |
| 3,733,767 | 5/1973 | Craik | 52/529 |
| 4,133,161 | 1/1979 | Lester | 52/543 |
| 4,266,385 | 5/1981 | Oehlert | 52/543 |
| 4,373,312 | 2/1983 | Kim | 52/309.9 |
| 4,499,645 | 2/1985 | Luomanen | 52/309.9 |

FOREIGN PATENT DOCUMENTS

| | | | |
|---|---|---|---|
| 1240641 | 8/1960 | France | 52/520 |
| 1321562 | 2/1963 | France | 52/530 |
| 98012 | 5/1961 | Norway | 52/531 |

*Primary Examiner*—Michael Safavi

*Attorney, Agent, or Firm*—Guido Modiano; Albert Josif

[57] ABSTRACT

Modular roofing panel comprising a substantially flat or corrugated or fretted body, two opposite longitudinal profiled edges. One of the edges has a continuous leg inclined with respect to the body so as to rise above the top of the corrugations or frets, and defines, at its own base, a drain channel. The other edge extends in an overlapping fashion so as to cover, in use, the leg and the respective drain channel of an adjacent modular roofing panel to delimit therewith a drain duct.

2 Claims, 3 Drawing Sheets

III
22
21
16
20
2
60
69
II
67
66
9
8
16
68
7
5
20
6
65
16a
60
I 66g
6g
68g
9g
69g
70g
8g
5g
65g
64g
1

66f
6f
67f
9f
69f
60f
8f
68f
5f
7f
65f
64f
1
50

66e
6e
67e
9e
8e
64e
5e
7e
65e
69e
1
50

MODULAR ROOFING PANEL

This is a continuation application of application Ser. No. 07/237,925, filed on Aug. 29, 1988, now abandoned.

BACKGROUND OF THE INVENTION

The present invention relates to a roofing panel assembly made of mutually adjacent modular roofing panels.

In the art it is known how to effect splicing of roofing panels or other modular roofing elements for covering flat or fret-shaped roofs by a notch and overlap method to ensure continuity of the roof covering between one roofing panel and the other, thereby preventing infiltration of rainwater at least in the roof's standard operating conditions. However, with the conventional flat or fret-shaped roofing elements, when the water level in the collecting and discharge channels delimited between adjacent roofing elements exceeds the top level of a vertical leg in the locks, the roof leaks.

This can occur in a number of occasions, e.g. owing to heavy rainfall which obstructs the channels, to rain combined with wind in which case water is driven above the level of the vertical rib in the locks, to a high ratio between the length (L in meters) and the inclication (I in percentage) of the pitches of a roof, e.g. $L/I>2$, to abundant hail which fills the channels between the roofing elements followed by rain, so that all the water cannot be drained away, and thus its level rises, and to melting snow, which may restrict or prevent water draining, especially at the front end of the roof pitches, where thaw is delayed.

It has already been suggested to provide various types of sealing along the roofing element overlaps, but the problem of water infiltrations has not been satisfactorily solved since thermal expansion and contraction movements and unavoidable aging of the sealants, at least in the long run, inevitably cause leakages.

SUMMARY OF THE INVENTION

An object of the present invention is to provide a modular roofing panel suitable for sealantless splicing between one panel and the adjacent one thereby obtaining panel roofs highly reliable against water infiltrations.

An object of the present invention is to allow the said roofing panel to be manufactured according to various corrugated or fretted or flat configurations.

Another object of the present invention is to provide a roofing panel suitable for obtaining roofs with a very high L/I ratio, i.e. also for flat or almost flat roofs.

Another object of the present invention is to provide hold down means for securing roofing panels to a supporting structure without requiring the perforation or nailing of the roofing panels.

Another object of the present invention is to provide a roofing panel which can be manufactured at competitive costs compared with conventional corrugated or fretted roofing panels.

These and other objects which will better appear hereinafter are achieved by a roofing panel comprising a substantially flat or corrugated or fretted intermediate body portion and one longitudinal edge formed with a continuous leg which is inclined with respect to the body portion so as to rise above it and delimit at its base, a drain channel, and its other longitudinal edge extending in overlapping fashion to cover, in use, the leg and its respective drain channel of an adjacent roofing panel and to delimit with it a longitudinal drain duct or lock.

Such a configuration allows a much higher rate of flow for the longitudinal lock than that at the joint between the longitudinal edges or lips of two conventional adjacent roofing panels arranged side by side. The water within the lock is not disturbed by the wind and is better protected against inclemency of the weather, e.g. hail, snow and against freezing and, above all, a substantially watertight seal in a transverse direction is obtained. Any water which may infiltrate in the drain duct or lock through the edges or lips of two roofing panels, e.g. owing to the action of the wind is discharged into the gutter within wide margins of safety without leakages to the underlying structure.

BRIEF DESCRIPTION OF THE DRAWINGS

Further features and advantages of the invention will become better apparent from the following detailed description of some preferred embodiments, given by way of non-limiting examples with reference to the accompanying drawings, wherein.

DESCRIPTION OF THE PREFERRED EMBODIMENTS

Figure 1:
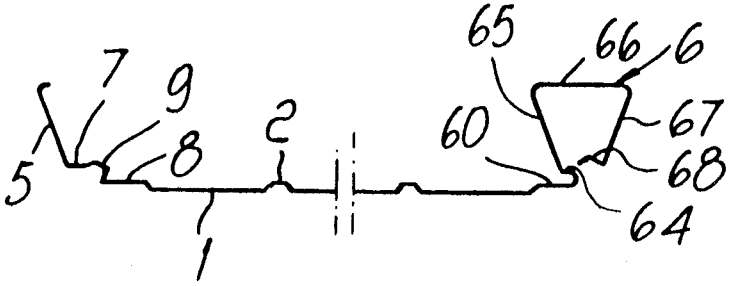
FIG. 1 is a front view of a roofing panel according to the invention.
Figure 3:
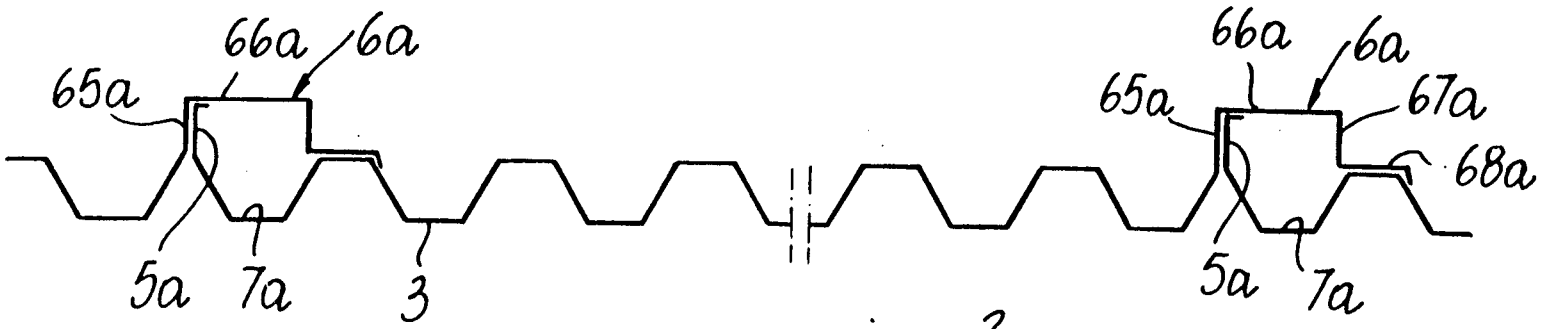
FIG. 3 is a front view of a plurality of fretted roofing panels according to another embodiment of the invention.
Figure 4:
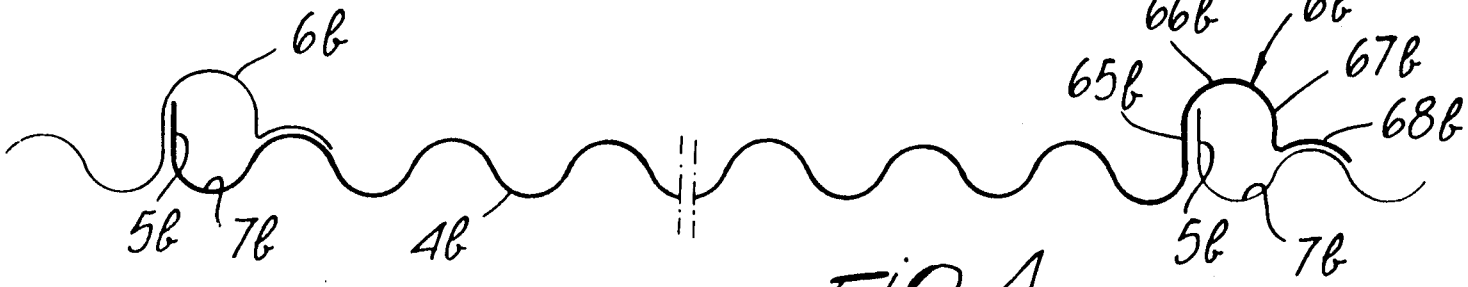
FIG. 4 is a front view of a plurality of corrugated roofing panels according to another embodiment of the invention.
Figures 2, 5, 6, 7:
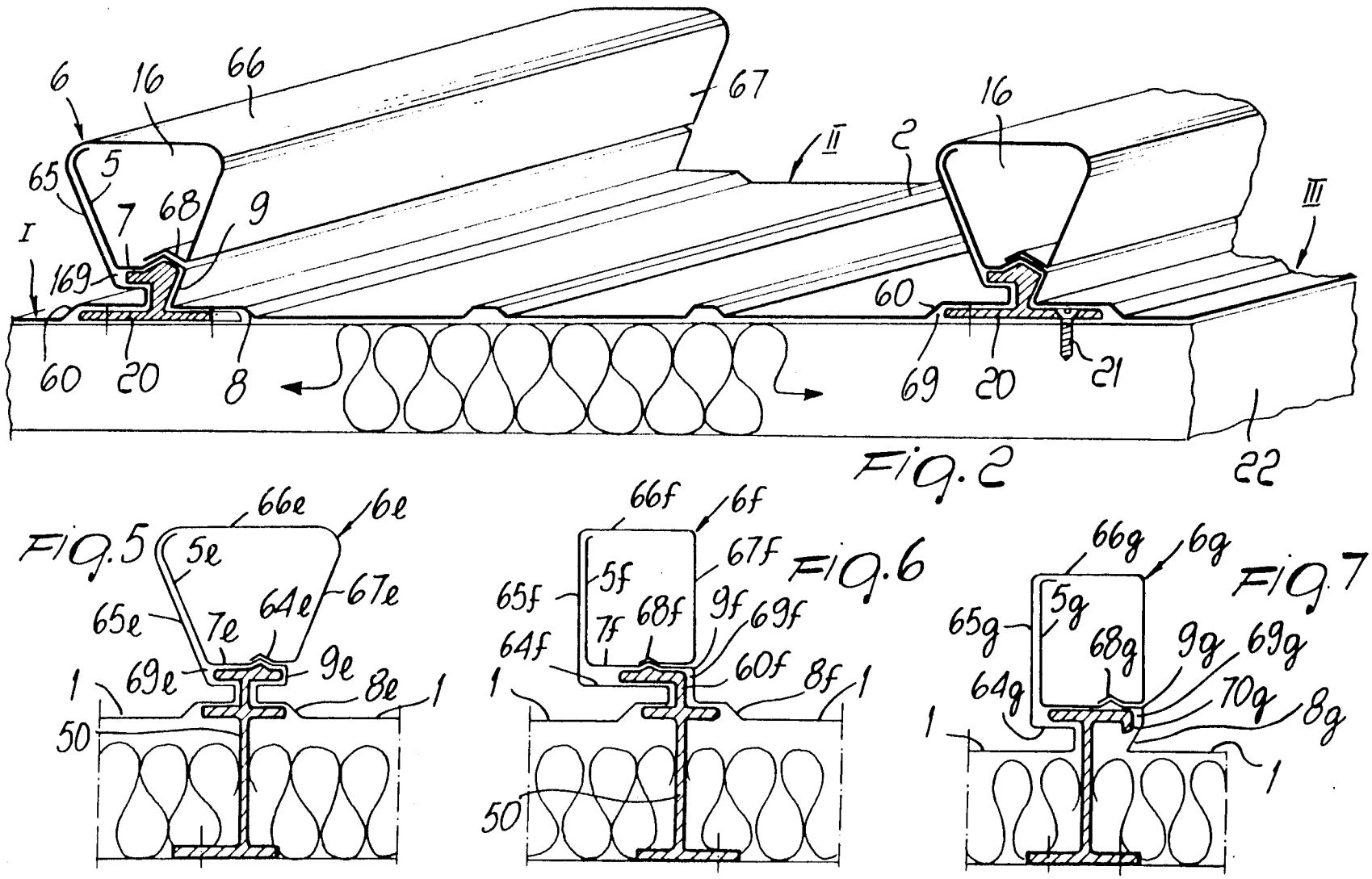
FIG. 2 is an axonometric sectional view of a portion of roof covered with roofing panels according to FIG. 1.
FIG. 5 is a sectional view of a portion of a roof at a drain duct joint between two roofing panels according to the invention.
FIGS. 6 and 7 are views, similar to FIG. 5, illustrating further embodiments of roofing panels.
Figure 8:
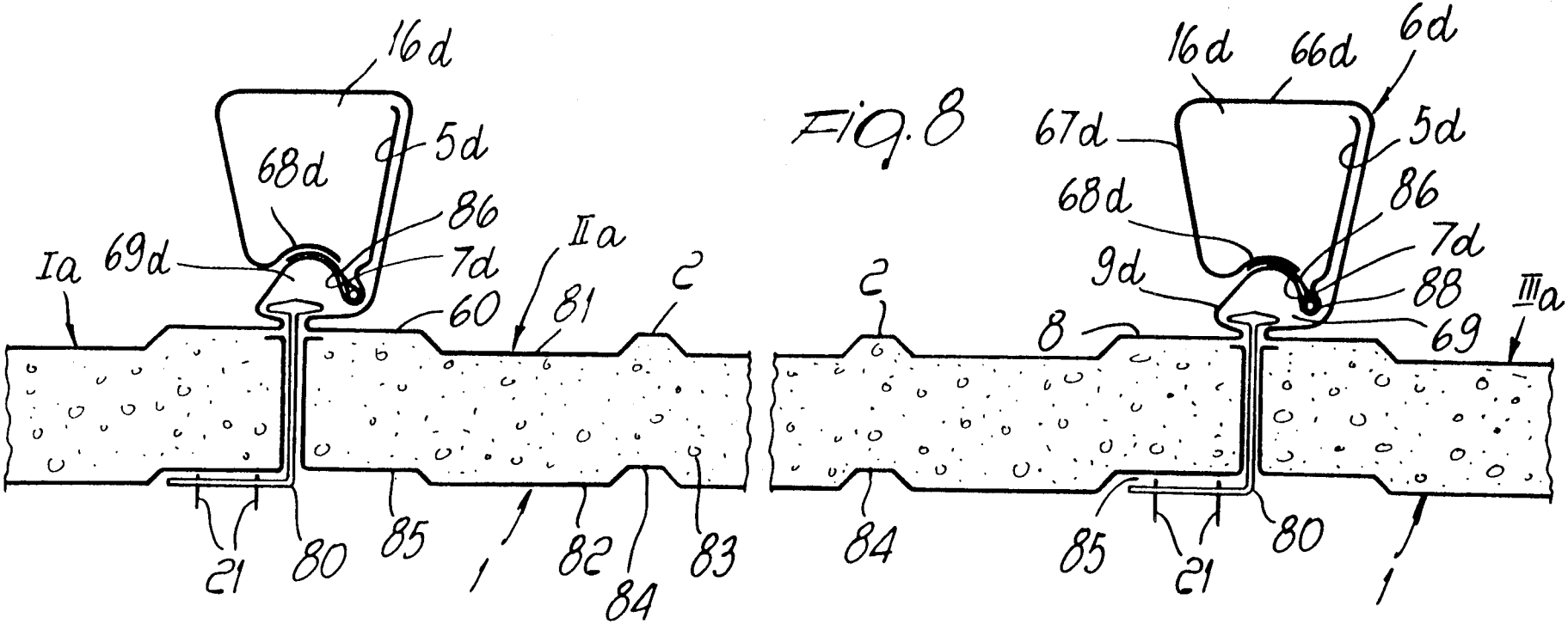
FIG. 8 is a front view of a portion of a roof covered with roofing panels according to another embodiment of the invention.

The description will refer more particularly to the embodiment shown in FIGS. 1 and 2. As for the embodiments shown in FIGS. 3-9, similar elements are designated by the same numerals of FIGS. 1-2 indexed by different letters. With reference to the figures, a roofing panel, which has a longitudinal and a lateral extension, comprises an intermediate body 1 which is planar and defining a plane of lay of the panel or formed with stiffening longitudinal ribs 2, as shown in FIGS. 1, 2 and 8 or a fretted intermediate body 3, as shown in FIG. 3, or a corrugated intermediate body 4 as shown in FIG. 4, and two opposite lateral edges 5 and 6. Edge 5 is shaped as a leg which rises inclined with respect to the lying of intermediate body, so as to form a high water head having a height considerably greater than the level of intermediate body 1. At its base, each leg 5 has at the bottom thereof a folded wall portion 7, 9 with an upwardly facing through-like surface which defines a longitudinal drain channel 7 (7*a*, 7*b*, 7*c*, 7*d*, 7*e*, 7*f*, 7*g*), which in the embodiments of FIGS. 1 and 5 to 7 has its bottom at a higher level than the level of the intermediate body 1 owing to the provision of two adjacent ribs or folds 8 (8*e*, 8*f*, 8*g*) and 9 (9*b*, 9*e*, 9*f*, 9*g*), whereas in FIGS. 3 and 4, each leg 5 is at the same level as the channels of the frets or corrugations. On the reverse side the folded wall portion 7, 9 defines seat means 9*a* (FIG. 1) for a clamp 20.

The edge formation 6 (6*a*, 6*b*, 6*c*, 6*d*, 6*e*, 6*f*, 6*g*) opposite to the edge formation 5 (5*a*, 5*b*, 5*c*, 5*d*, 5*e*, 5*f*, 5*g*) is box-like or cap-shaped so as to overlap the leg 5 and its respective drain channel 7 (7*a*, 7*b*, 7*c*, 7*d*, 7*e*, 7*f*, 7*g*) of a roofing panel arranged side by side and to delimit therewith a drain duct or lock 16, which encircles said drain channel 7.

More particularly in FIG. 1 the edge formation 6 is shaped box-like in such a way as to have a folded wall portion comprising a base rib 60 which is followed by a fold with a short overhanging portion 64, a side wall 65 which extends from the portion 64 at an angle with respect thereto and is substantially parallel to the leg 5, a top portion or bridge 66 which extends substantially parallel to the body 1 (FIGS. 1 and 2 and 5 to 7) or to the bottom 3 or the ridges of the frets (FIG. 3), or is rounded (FIG. 4), and an opposite free side wall 67 terminating with a bottom wall formed like a rib 68 which is located at a short distance from or above the folded portion 64 to form a gap 68*a* therebetween (in the examples of FIGS. 1 and 2 and 5 to 8) or extends above the ridge of a corrugation or a fret in the examples of FIGS. 3 and 4. The leg defining wall 5 of each roofing panel (see FIGS. 2 and 5 to 8), is designed to be surmounted, in use, by an overlapping edge 6 of an adjacent roofing panel, so that the leg 5 leans against or is close to its wall 65 and delimits an inner tubular duct or lock 16 and a recess or gap 69 below its folds 8 and 9. The recesses 60, 69, 169 define seats to receive a hold down clamp or fastener 20 in FIGS. 2 and 6, or 50 in FIG. 5, or 70 in FIG. 7, or 80 in FIG. 8. The duct or lock 16 covers the drain channel 7 and increases the draining capacity. The side walls 65 and 67 diverge upwardly from each other and confer a trapezoidal shape to the box-like edge formation 6.

The clamps are designed to fix the roofing panels in position without forming holes in them, this being an important feature, since the provision of holes in the roofing panels is inevitably responsible for undesired infiltrations.

Each clamp 20, 50, 70 or 80 is secured, e.g. by means of screws 21 (FIG. 2), to a solid decking or supporting structure 22 arranged underneath and allows the roofing panels to expand and contract. For the sake of clarity FIGS. 2 and 8 show on the left side an edge formation of a first adjacent roofing panel I, I*a*, in the middle a second adjacent roofing panel II, II*a*, and, on the right, an edge formation of a third adjacent roofing panel III, III*a*.

Figure 9:
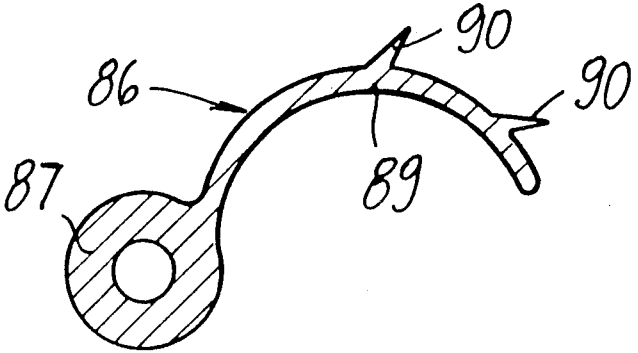
FIG. 9 is a cross-section view of a seal gasket.

In the embodiment shown in FIGS. 8 and 9 each roofing panel 1 comprises a sandwich, i.e. two parallel metal skins or sheets 81 and 82 defining an intervening space therebetween and attached to an intermediate sheet or layer 83 e.g. made of foamed heat-insulating material and arranged in said intervening space. The skins 81 can have ribs 2, 8 and 60, whereas the skin 82 can be formed with respective beads 84 and 85.

Between the channel 7*d* and the rib 68*d* at each joint between adjacent panels there is provided a sealing gasket 86 of plastic material or rubber or another suitable material, designed to prevent water infiltration into the lock 16. The gasket 86 advantageously has a side bead 87 arranged to be seated, in use, in a respective narrow seat 88 in the channel 7*d*, and a curved laminar body 89 from which one or more serrations 90 extend outwardly in order to tightly engage against the rib 68*d*.

It will be noted that a modular roofing panel according to the invention as described above and illustrated in the accompanying drawings besides preventing water infiltration at the joints, brilliantly solves the problems regarding thermal expansion, and can be used for covering roofs with small inclination. Moreover, a roofing panel according to the invention can comprise panels either flat or corrugated having a length equal to that of the roof pitches. Roofing panels can be manufactured using a variety of materials, such as metals and metal alloys, plastic materials, reinforced plastic materials, e.g. fiberglass-reinforced plastics, or other suitable materials which can be rolled or extruded.

Tests have shown a very high reliability of the roofing panels according to the invention on roofs having a pitch ratio $L/I=20$, i.e. for $L=20$ m and $I=1\%$ or $L=10$ m and $I=0.5\%$; that is even with flat or almost flat roofs, which are conventionally covered with resilient materials, such as bitumens or synthetic resin sheets.

In practice a roof covered with roofing panels according to the present invention has an unlimited life, ensures safe seal, even with 0.5% pitch inclination and, independently of the length of the pitches, has excellent walkability and applicability to any base structure 22, as illustrated in FIGS. 2, 5, 6 and 7.

I claim:

1. A roofing panel assembly comprising a plurality of mutually juxtaposed roofing panels, each of said roofing panels having a lateral extension and a longitudinal extension and wherein at least a first adjacent, a second adjacent and a third adjacent of said roofing panels comprise each on one longitudinal side thereof a first lateral longitudinally extending edge formation, on the opposite longitudinal side thereof a second lateral longitudinally extending edge formation laterally at a distance from said first lateral edge formation, and an intermediate body portion between said first lateral edge formation and said second lateral edge formation, said intermediate body portion defining a plane of lay of the roofing panel, and wherein said first adjacent, said second adjacent and said third adjacent of said roofing panels are in juxtaposed relationship to each other, said second adjacent of said roofing panels being arranged between said first adjacent and said third adjacent of said roofing panels, wherein said first adjacent roofing panel is arranged with said second lateral edge formation thereof at the side of said first lateral edge formation of said second adjacent of said roofing panels and in overlapping relationship therewith, wherein said third adjacent roofing panel is arranged with said first lateral edge formation thereof at the side of said second lateral edge formation of said second adjacent of said roofing panels and in overlapping relationship therewith, wherein said first lateral edge formation comprises a longitudinal leg defining wall upwardly extending with respect to said intermediate body portion and, at the bottom of said leg defining wall at a level higher than the level of said plane of lay of said intermediate body portion, a first folded wall portion connecting said leg defining wall with said intermediate body portion, said first folded wall portion having an upwardly facing through-like surface area defining a drain channel portion and, on the reverse side thereof, a downwardly facing surface area defining a first seat means arranged below said drain channel portion, wherein said second lateral edge formation has substantially an elongated box-like shape comprising a first upwardly extending side wall, a second folded wall portion connecting the bottom of said first side wall to said intermediate body portion, said second folded wall portion facing said first folded portion at a distance therefrom to form and interspace therebetween and cooperating with said first seat means in assembled condition of said roofing panels, said first side wall having a prevailing portion thereof extending substantially parallel to and facing said leg defining wall of said first edge formation in assembled condition of said roofing panels, said box-like shape comprising further a free upwardly extending side wall at a lateral distance from said first upwardly extending side wall to leave free a duct cavity therebetween, a top wall connecting upwardly said first side wall and said free side wall and a rib-like bottom wall extending from the bottom of said free side wall towards said first side wall at a distance therefrom to leave a gap therebetween, said gap allowing passage therethrough of said leg defining wall of said first edge formation and cooperating therein with said first seat means thereof when said first edge formation and said second edge formation are in overlapped relationship to each other whereby said first edge formation and said second edge formation define a draining duct encircling said draining channel of said first edge formation, whereby the bottom of said draining duct defined by said rib-like bottom wall and said draining channel is arranged at a level higher than the level of said plane of lay of said intermediate body portion of the roofing panel, wherein the roofing assembly further comprises at least one clamp means having a hook formation and a base formation, said hook formation being engaged in said first seat means between said first folded wall portion and said second folded wall portion and being adapted to hook said second folded wall portion, said base formation being adapted to be fastened to a deck, wherein said first folded portion has at least two consecutive folds and wherein said second folded wall portion has at least two further consecutive folds facing respectively said two consecutive folds of said first folded wall portion to define two consecutive seats for said clamp means.

2. A roofing panel assembly comprising a plurality of mutually juxtaposed roofing panels, each of said roofing panels having a lateral extension and a longitudinal extension and wherein at least a first adjacent, a second adjacent and a third adjacent of said roofing panels comprise each on one longitudinal side thereof a first lateral longitudinally extending edge formation, on the opposite longitudinal side thereof a second lateral longitudinally extending edge formation laterally at a distance from said first lateral edge formation, and an intermediate body portion between said first lateral edge formation and said second lateral edge formation, said intermediate body portion defining a plane of lay of the roofing panel, and wherein said first adjacent, said second adjacent and said third adjacent of said roofing panels are in juxtaposed relationship to each other, said second adjacent of said roofing panels being arranged between said first adjacent and said third adjacent of said roofing panels, wherein said first adjacent roofing panel is arranged with said second lateral edge formation thereof at the side of said first lateral edge formation of said second adjacent of said roofing panels and in overlapping relationship therewith, wherein said third adjacent roofing panel is arranged with said first lateral edge formation thereof at the side of said second lateral edge formation of said second adjacent of said roofing panels and in overlapping relationship therewith, wherein said first lateral edge formation comprises a longitudinal leg defining wall upwardly extending with respect to said intermediate body portion and, at the bottom of said leg defining wall at a level higher than the level of said plane of lay of said intermediate body portion, a first folded wall portion connecting said leg defining wall with said intermediate body portion, said first folded wall portion having an upwardly facing trough-like surface area defining a drain channel portion and, on the reverse side thereof, a downwardly facing surface area defining a first seat means arranged below said drain channel portion, wherein said second lateral edge formation has substantially an elongated box-like shape comprising a first upwardly extending side wall, a second folded wall portion connecting the bottom of said first side wall to said intermediate body portion, said second folded wall portion facing said first folded portion at a distance therefrom to form and interspace therebetween and cooperating with said first seat means in assembled condition of said roofing panels, said first side wall having a prevailing portion thereof extending substantially parallel to and facing said leg defining wall of said first edge formation in assembled condition of said roofing panels, said box-like shape comprising further a free upwardly extending side wall at a lateral distance from said first upwardly extending side wall to leave free a duct cavity therebetween, a top wall connecting upwardly said first side wall and said free side wall and a rib-like bottom wall extending from the bottom of said free side wall towards said first side wall at a distance therefrom to leave a gap therebetween, said gap allowing passage therethrough of said leg defining wall of said first edge formation and cooperating therein with said first seat means thereof when said first edge formation and said second edge formation are in overlapped relationship to each other whereby said first edge formation and said second edge formation define a draining duct encircling said draining channel of said first edge formation, whereby the bottom of said draining duct defined by said rib-like bottom wall and said draining channel is arranged at a level higher than the level of said plane of a lay of said intermediate body portion of the roofing panel, wherein the roofing assembly further comprises at least one clamp means having a hook formation and a base formation, said hook formation being engaged in said first seat means between said first folded wall portion and said second folded wall portion and being adapted to hook said second folded wall portion, said base formation being adapted to be fastened to a deck, wherein said first folded wall portion and said rib-like bottom wall portions have each an arcuated portion in mutual overlapping relationship to each other and wherein the assembly further comprises a sealing gasket interposed between said rib-like bottom wall and said first folded wall portion, said sealing gasket comprising a laminar body and bead connected to said laminar body, a plurality of serrations extending from said laminar body.

* * * * *